United States Patent [19]

Timmerman

[11] 4,253,517

[45] Mar. 3, 1981

[54] WASTE HEAT UTILIZATION SYSTEM

[76] Inventor: Robert W. Timmerman, 25 Upton St., Boston, Mass. 02118

[21] Appl. No.: 946,799

[22] Filed: Sep. 28, 1978

Related U.S. Application Data

[62] Division of Ser. No. 735,079, Oct. 22, 1976, Pat. No. 4,168,030.

[51] Int. Cl.[3] ..... F28F 27/02; F28B 9/04

[52] U.S. Cl. ..... 165/97

[58] Field of Search ..... 165/101, 103, 137, 97, 165/100, 34

[56] References Cited

U.S. PATENT DOCUMENTS

| | | | |
|---|---|---|---|
| 2,076,033 | 4/1937 | Kniskern | 165/97 |
| 2,649,698 | 8/1953 | Goldmann | 165/97 |
| 3,827,479 | 8/1974 | Fejes | 165/101 |
| 3,990,504 | 11/1976 | Kolthoff, Jr. | 165/97 |

*Primary Examiner*—Sheldon Richter

*Attorney, Agent, or Firm*—Wolf, Greenfield & Sacks

[57] ABSTRACT

Power generating plants discharge steam or hot water typically from a steam turbine to a condenser system for the purpose of cooling the discharged fluid prior to its being recirculated. The condenser system receives water from an ambient source pumped using a circulating water pump, said water being elevated to a temperature on the order of 115° F. to 125° F. upon passing through the condenser system. The condenser system can operate in basically two different states to provide either single pressure, single pass condenser operation when the waste hot water is discharged to the source and not used, or multi-pressure, multi-pass condenser operation to maintain an elevated hot water supply that is fed to a load (utilization equipment). Valve controls are provided for enabling serial-to-parallel and vice versa, switching between modes of operation without difficulties and with only a slight drop in load during the transition. The heated water is temperature controlled to the above mentioned range. The system is particularly adaptable to use with a plurality of power plants by combining the discharges of several plants as needed, or by removing plants from the waste heat system when not needed. A special pressure control is provided at all plants to compensate for variations in water flow occasioned by changes in electric generation.

7 Claims, 2 Drawing Figures

WASTE HEAT UTILIZATION SYSTEM

This is a division of application Ser. No. 735,079, filed Oct. 22, 1976 now U.S. Pat. No. 4,168,030.

BACKGROUND OF THE INVENTION

The present invention relates in general to a waste heat utilization system. More particularly, the present invention is concerned with an efficient system for utilizing power plant waste heat by attaining a stream of hot water preferably in the range of about 105° F. to 125° F.

Electrical power is typically generated using a boiler powered by either a fossil fuel or an atomic fuel and that generates steam for driving a steam turbine. Electricity is generated upon rotation of the steam turbine. The discharged steam from the turbine which may be at a temperature of say 100° F. passes to a plant condenser where the steam is condensed prior to recirculation to the boiler. The condenser is a heat transfer device and typically water at an ambient temperature enters the condenser and is heated to an elevated temperature of say 90° F. The water may be pumped through the condenser from a lake, for example, and may be discharged at the elevated temperature back into the lake. Systems have been devised previously wherein the waste heat is elevated in temperature even by using a secondary heating source to, for example, heat a building. Generally, systems of this type have been limited to use with only a single power plant. A paper was published in the "transactions of the ASME" (paper No. 75-PWR-12, published in July 1976). Ileri, Reistat, & Schmisseur discussed the use of waste heat from power plants. They discussed in general two limiting cases including a high temperature scheme using hot water derived directly from the plant extraction steam system and a low temperature scheme using the plant circulating water at the temperature at which it comes from the plant which may be on the order of typically 90° F. The high temperature scheme has certain disadvantages in that it requires extensive plant modifications and also requires a special high temperature conduit. On the other hand the low temperature scheme is inadequate because of the relatively low unstable temperature at which the water is delivered. Also, neither of the schemes proposed in that paper provide for using more than one power plant as a heat source.

Accordingly, one object of the present invention is to provide a system for utilizing power plant waste heat in obtaining a stream of hot water preferably in the range of 105° F. to 125° F.

Another object of the present invention is to provide a waste heat utilization system which is efficient in operation and which permits the combining of the discharges of several plants in the total system concept.

A further object of the present invention is to provide a waste heat utilization system that comprises an improved condenser system and associated control for providing either single pressure, single pass condenser operation or multi-pressure, multi-pass condenser operation.

Still a further object of the present invention is to provide a waste heat utilization system in accordance with the preceding object and which includes temperature control means for maintaining the stream of hot water at a predetermined temperature and preferably maintaining the same temperature for the discharges from each power plant.

Another object of the present invention is to provide a special pressure control provided at all plants to compensate for variations in water flow occasioned by changes in electric generation.

SUMMARY OF THE INVENTION

To accomplish the foregoing and other objects of this invention, there is provided a system for utilizing waste heat from a power plant and which comprises a condenser system having a plurality of stages and associated controls for permitting either single pressure, single pass condenser operation or multi-pressure, multi-pass condenser operation. A controlled valving arrangement controls either serial or parallel flow through the condensers of the condenser system. The system of the present invention preferably interconnects a plurality of power plants with the hot water discharge streams from each plant being connected in common, and from thence to the utilization equipment. At each plant the system has the capability of either discharging to the utilization equipment or discharging to the water source which may occur when the waste heat water is not necessary. In accordance with the scheme of this invention the circulating water discharge temperature is also controlled to maintain a constant temperature regardless of the load. Because any plant can switch to single pass operation without dropping the load, it is possible to combine the discharges of several plants as needed, or to take plants off the waste heat system when not needed. Because the water flow out of any one plant will vary as the electric generation varies, in accordance with the invention there is provided a special pumping system which accepts the flow from any one plant and pumps it through the utilization system. To provide this operation each plant includes its own forwarding pump and in accordance with the associated control a constant pressure is maintained at the suction end of the forwarding pump. If the flow from the power plant increases, the suction pressure tends to rise but in accordance with the control the pump compensates by increasing the flow through the pump and thus maintains a constant suction pressure. The reverse occurs when the flow decreases.

The system of the present invention can be provided either as a once-through system, or as a recirculation system. When constructed as a recirculation system the water flows from the plant through the supply piping, through the utilization apparatus and back through the return piping to the plant heat sink. In a once-through system, the heated water after being used is simply returned to a common body of water. This second arrangement for the system of this invention is particularly useful when the plant and the utilization equipment are both disposed near to a common water way.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

In accordance with the present invention power plant waste heat is utilized by obtaining a stream of hot water preferably about 105° F. to 125° F. Generally, the temperature level of waste heat is the compromise between a high temperature, which reduces problems at the utilization end, and a low temperature, which maintains an increase in the amount of power generation that is possible, reduces the complexity of the conduit, and reduces the cost and complexity of the modifications to the power plant. The highest temperature was chosen consistent with the conventional turbine back pressure limitation of 5 in. Hg. This results in a water outlet temperature of between 115° F. and 125° F., depending upon the condenser used. By allowing for a 5° F. loss for transmission and distribution, the temperature at the user is in the range of 110° F. to 120° F. This temperature is sufficiently high to use directly in many types of heating systems.

Figure 1:
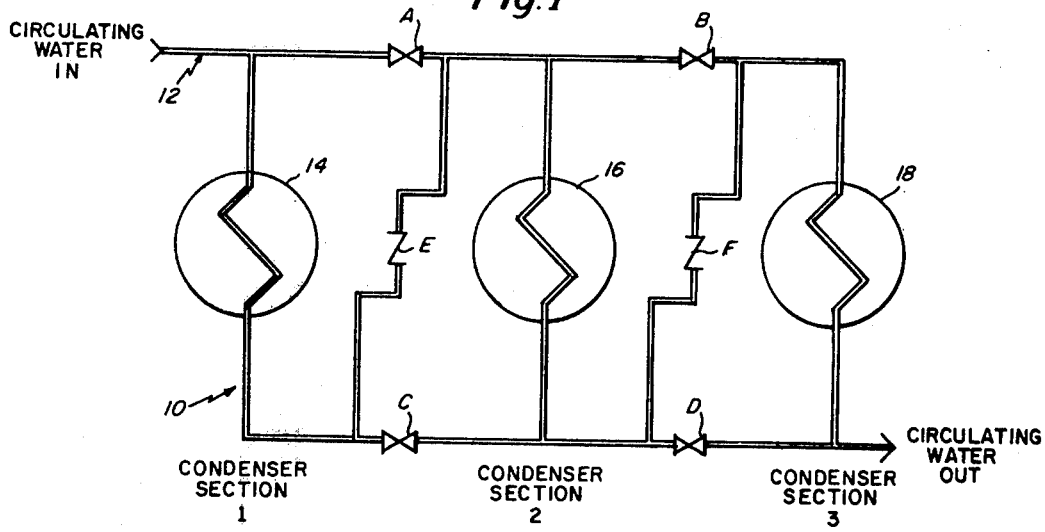
FIG. 1 is a schematic diagram of the condenser system of the present invention.

FIG. 1 shows a preferred embodiment of the condenser system 10 of this invention. A condenser system is used at each plant as shown in the schematic diagram of FIG. 2. The condenser system comprises a plurality of pieces of water conduit 12 schematically shown in FIG. 1 by coupling lines between the components of the system. The system components basically comprise condensers 14, 16 and 18, each of which is of conventional design and a valving scheme comprised of valves A-F. In the particular embodiment shown in FIG. 1 there are three condenser sections. However, it is understood that two or more than three sections could also be employed. Each of the valves shown in FIG. 1 is preferably controlled electrically and may be controlled by voltage level signals for controlling gradually the opening and closing of the valves.

For single pressure operation the valves A, B, C and D are open and the check valves E and F are closed. With this set up water is pumped by the plant circulating water pump (note pump 20 in FIG. 2) in parallel through each of the condensers 14, 16 and 18. Only a single pass is made through any one of the condensers by way of the three paths that are provided between the water input and the water output. Typically, if the temperature of the input water is 70° F. then the temperature of the output water may be 90° F. Although not depicted in FIG. 1 each of the condensers, of course, has an output line coupled to the turbine for receiving steam and a second output coupling by way of a recirculating pump to pump the water back to the boiler of the plant.

To convert to multi-pressure, multi-pass operation, the valves B and D are controlled so as to start closing gradually. This causes a pressure drop across the check valve F causing this valve F to open. Although the direction of water flow through the condenser 18 is the same as before, the source is now the discharge of sections 1 and 2, instead of raw water at ambient temperature. As soon as flow is established through the check valve F, valves A and C may then be controlled to commence closing, thereafter causing check valve E to open. When this occurs the condenser system is operating as a three pass condenser. Regarding the direction of flow in the schematic diagram of FIG. 1 the flow is down in all three condensers with all condensers being connected essentially in series.

Figure 2:
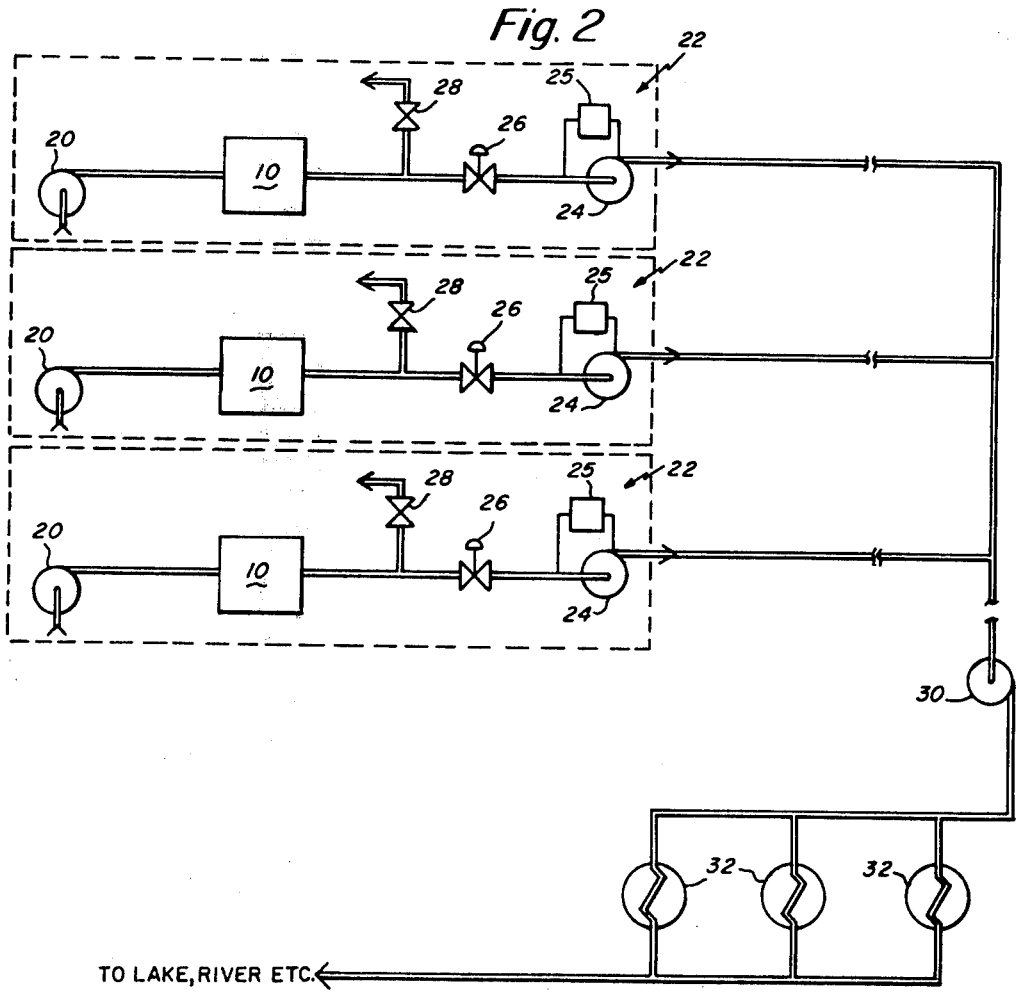
FIG. 2 is a schematic diagram showing a system of the present invention employing the condenser system shown in FIG. 1 and comprising a system combining a plurality of power plants.

FIG. 2 is a schematic diagram of the system concept of the present invention wherein a plurality of plants 22 are merged into a single utilization system. In each plant there is the condenser system 10, the plant circulating water pump 20, the plant forwarding pump 24, a temperature control valve 26, and a flow valve 28. The discharge connections from each of the pumps 24 may couple by way of a booster pump 30 to utilization equipment comprising a plurality of utilization apparatus 32.

In accordance with the teachings of the present invention the operation of the valves 28, which may occur individually in each plant, is controlled in accordance with the control for the valve arrangement shown in FIG. 1. When in the single pass mode of operation the valves of FIG. 1 are in the positions indicated hereinbefore for providing single pass through the condensers. At the same time the valve 28 is controlled to be open discharging the water from the condenser system 10 to the ambient water source. This may occur when the heated water from any one particular plant is not needed in the overall system. On the other hand when the waste heat is to be utilized the condenser system shown in FIG. 1 is switched to its multi-pressure, multi-pass mode of operation. At the same time the valve 28 of that particular plant is maintained in a closed position preventing water discharge to the water source. In this mode of operation the heated water is passed through the temperature control device 26 to the forwarding pump 24.

In accordance with the present invention the system also controls the circulating water discharge temperature passed by the pumps 24 at a constant value regardless of the load on the system. The temperature control device 26 shown in FIG. 2 may comprise a butterfly valve and standard temperature controller. In this way water temperature is controlled by controlling water flow. With the unique valving arrangement of this invention any one of the plants can switch between the different modes of operation without effecting, to any great degree, the electrical load and further it is possible to readily combine the discharges of several plants as shown in FIG. 2 as the waste heat from the plants is needed. When the waste heat is not to be utilized it is also readily possible to remove certain of the plants from the utilization system.

The water flow out of any single plant varies as the electric generation varies. Thus, there is provided a pumping system including the forwarding pumps 24 which accepts the flow from the plant condensers and efficiently pumps the water through the transmission and distribution system. Thus, each of the pumps 24 has associated therewith a pressure sensitive controller 25 which may be of conventional design. The purpose of the control scheme is to maintain a constant pressure at the suction side of the pumps 24. When the flow from the power plant increases the suction pressure will tend to rise. The devices 25 respond to this rise in pressure by increasing the pumping capability of the pump 24. Of course, reverse operation is also possible so that if the flow decreases the device 25 responds by decreasing the pump output.

The waste heat system of this invention may be designed either as a once-through system or as a recirculation system. In the recirculation embodiment the water flows from the plant, through the supply piping, through the utilization apparatus and returns to the plant heat sink. At the plant the heat not used by the utilization apparatus is dissipated before returning the water to the condenser.

The preferred system is the once-through system as it is less costly. This arrangement is particularly advantageous when the plant and the utilization equipment are situated on a common body of water. Fortunately, this embodiment is usable in many parts of this country adjacent the major lakes or rivers. With this arrangement the water flows from the body of water, through the plant condensers, through the supply piping and utilization apparatus, and is returned to the body of water from whence it came without having to return all of the water to the plant location.

In the total system concept a central control area is provided for controlling which plant waste heat is necessary for proper operation of the utilization equipment. The dispatcher for the waste heat system could project plant loadings from the electrical dispatcher on a daily basis, and use these to compute heat available. Weather forecasts would also furnish an input to the system for estimating the amount of heat that would be required by the utilization equipment. From all of this information and possibly other information a schedule of the plants that would be operated to furnish waste heat could be prepared.

Also, the system is designed for taking into account any imbalances between the heat available and the heat required so that there will be sufficient heat to meet any peak demands. This system is designed to achieve a slight surplus of heat available over heat required. Major surpluses in the system should be avoided of course because of the waste of fuel that occurs. For example, with 10 available plants, it should be possible to match supply and demand within 10% if all the plants are approximately of the same size. If some plants are smaller then closer matching is possible.

The condenser system of the present invention is particularly advantageous especially in combination with the operation of the flow valve 28. The proper heating of the hot water occurs in the multiple mode of operation and yet the system also has the capability of reverting to the single mode of operation when the heat is not required. The system therefore is extremely efficient especially when coupled with the improved pressure feature concept of the invention.

Having described one embodiment of the concepts of this invention, it should now become apparent to those skilled in the art that numerous modifications can be made in the concepts of this invention and that all such changes and modifications are to be limited only by the appended claims. For example, many different types of condensers can be used in the system. Also, the pumps that are used are of conventional design and the valves that are operated are also preferably readily available and of conventional design. The utilization equipment may be of many different types including standard heating systems for heating areas of buildings.

What is claimed is:

1. A condenser system for use in a waste heat utilization system comprising;

a plurality of condensers each for passing cold water for the purpose of heating the water and each including water inlet means coupling from a source of water and outlet means, fluid conduit means including a number of conduit sections intercoupling the plurality of condensers, and valve control means including a plurality of flow control valves connected in the conduit means and means for controlling the valves to be in a first position interconnecting the condensers in parallel with single pass of water through each condenser and to be in a second position interconnecting the condensers in series with multiple pass of water through the condensers, said fluid conduit means intercoupling said condensers in a parallel arrangement and said flow control valves comprising at least three valves including a first valve between the inlet means of the condensers, a second valve between the outlet means of the condensers, and a third valve coupling between said first and second valves, said first and second valves being controlled valves and said third valve being a check valve coupling between an outlet means of one condenser and an inlet means of another condenser.

2. A condenser system as set forth in claim 1 wherein said first and second valves are operated to be open for single pass operation said third valve being closed, and said first and second valves being operated to be closed for multiple pass operation said third valve being open.

3. A condenser system as set forth in claim 1 in combination with flow diverting means coupled to the output of the condenser system and controlled to be open when the condenser system is in its single pass mode of operation and closed when the condenser system is in its multiple pass mode of operation.

4. A condenser system as set forth in claim 1 in combination with a pump means for pumping water to the condenser system.

5. A condenser system as set forth in claim 1 in combination with a temperature controller coupled from the output of the condenser system.

6. A condenser system as set forth in claim 8 in combination with a forwarding pump, distribution lines and utilization equipment.

7. A condenser system for use in a waste heat utilization system comprising;

a plurality of condensers each for passing heated water for the purpose of cooling the water and each including water inlet means coupling from a source of water and outlet means, fluid conduit means including a number of conduit sections intercoupling the plurality of condensers, and valve control means including a plurality of flow control valves connected in the conduit means and means for controlling the valves to be in a first position interconnecting the condensers in parallel with single pass of water through each condenser and to be in a second position interconnecting the condensers in series with multiple pass of water through the condensers, wherein said plurality of condensers includes three condensers, and said valve control means includes four controlled valves and two check valves, two of said controlled valves being interconnected between inlet means of adjacent condensers and two other controlled valves being interconnected between outlet means of adjacent condensers, said check valves being interconnected between outlet means of one condenser and inlet means of an adjacent condenser.

* * * * *